United States Patent [19]

Nelson

[11] 4,363,941

[45] Dec. 14, 1982

[54] PATCH MODULE

[75] Inventor: Calvin G. Nelson, Brooklyn Park, Minn.

[73] Assignee: Magnetic Controls Company, Minneapolis, Minn.

[21] Appl. No.: 277,677

[22] Filed: Jun. 26, 1981

[51] Int. Cl.[3] ..... H01H 9/00

[52] U.S. Cl. ..... 200/1 R; 200/51.09; 200/51.1; 200/292; 307/112; 339/17 L

[58] Field of Search ..... 200/1 R, 1 A, 51 R, 200/51.01, 51.02, 51.03, 51.04, 51.05, 51.06, 51.07, 51.08, 51.09, 51.1, 51.11, 51.12, 51.13, 51.14, 51.15, 51.16, 51.17, 292; 307/112; 339/17 L, 18 R, 18 P; 361/352; 179/1 PC

[56] References Cited

U.S. PATENT DOCUMENTS

| | | | |
|---|---|---|---|
| 4,037,186 | 7/1977 | Palmer et al. | 200/51.1 |
| 4,140,918 | 2/1979 | Lancaster | 307/112 |
| 4,203,066 | 5/1980 | Buck | 324/51 |

*Primary Examiner*—A. T. Grimley

*Assistant Examiner*—Morris Ginsburg

*Attorney, Agent, or Firm*—Dorsey & Whitney

[57] ABSTRACT

A patch or access module usable with an insertable patch plug having a plurality of electrical contact elements. The patch or access module includes a circuit board, a first electrical circuit electrically connected with a first point on the circuit board, a second electrical circuit electrically connected with the second point on the circuit board and switch contact means for selectively making electrical connection between the first point and the second point and for making electrical connection between the first point and the electrical contact elements of the patch plug upon insertion of the patch plug into the patch or access module. The switch contact mechanism includes a first portion electrically engaged with the first point, a second portion adapted for selective electrical engagement with the second point and a third portion adapted for limited movement relative to the circuit board for electrical engagement with the electrical contact element of the patch plug when the plug is inserted into the patch module.

16 Claims, 16 Drawing Figures

PATCH MODULE

BACKGROUND OF THE INVENTION

The present invention relates generally to a patch or access module usable with an insertable patch plug, and more particularly, to an improved switch and contact element in a patch module for electrically connecting or accessing certain leads of a data transmission circuit to a patch cord and electrically disconnecting such leads from their normal electrical connection within the patch module.

Several types of patch or access assemblies presently exist in the prior art. Such assemblies typically include an array of individual patch or access modules disposed in side by side relationship with one another. In these assemblies, each module is adapted for selectively connecting and disconnecting various electrical circuits or leads within the module. In one embodiment, each of the patch modules includes an access to the leads on the computer side of a data transmission circuit and an access to the leads on the modem side of a data transmission circuit. The respective leads from the computer are normally electrically connected with the leads on the modem side, thus providing a through circuit. Patch cords are available for use with the patch modules to electrically connect or patch one set of leads from a particular computer with a second set of leads for a particular modem remote from the particular module in question. Each of these patch cords includes a patch plug on opposite ends for making electrical connection with or accessing the respective computer and modem leads.

To accomplish the above patching function, the patch plug at one end of the patch cord is inserted into an access opening associated with the desired computer data transmission leads and the patch plug at the other end of the patch cord is inserted into the access opening associated with the desired modem data transmission leads. The insertion of the patch plugs into the patch modules accomplishes two things: (1) it causes the normal electrical connection between the computer and modem leads in a particular patch module to be electrically disconnected and (2) it causes electrical connection to be made between the leads being accessed and the corresponding contact elements in the patch plug.

A variety of mechanisms presently exist in the prior art for accomplishing this switching and contact function. In U.S. Pat. No. 4,140,918, the patch plug consists of a generally cylindrical element having a plurality of electrical contacts in which the switching and contact functions are performed by inserting the cylindrical plug into the patch module jack and rotating the plug. In U.S. Pat. No. 4,203,066, the switching function is accomplished by shifting the position of an entire switching board as the patch plug is inserted, with the electrical contact being made as a result of engagement between electrical contacts on the patch plug and contact portions on the surface of the printed circuit board. In another known structure, a plurality of contact springs are utilized with each of the springs associated with one of the leads. As the patch plug is inserted, the spring contact members are electrically disconnected from the leads and electrical contact is made between appropriate contacts in the patch plug and contact portions on the surface of the printed circuit board.

While many of the prior art patch modules and switch-contact mechanisms perform satisfactorily, they do have certain limitations. In many, the switching mechanism is structurally quite complicated, thus leading to high costs in manufacture and fabrication as well as increased chances of malfunction. Also, the contact mechanism in most modules consists of a contact element in the patch making electrical contact with a contact surface on the printed circuit board. This latter structure results in two disadvantages. First, because of the extremely high wear in the area where electrical contact is made, the anticipated useful life of the module is limited. Second, as a result of the continuous wear between the contact elements of the patch plug and the contact surfaces on the printed circuit board, fiber from the printed circuit board is dislodged, thereby resulting in intermittent circuits being formed. This often leads to malfunction of the module.

Accordingly, there is a real need in the art for a patch module having an improved switching and contact mechanism for substantially reducing or eliminating wear between the contact elements associated with the patch plug and the printed circuit board.

SUMMARY OF THE INVENTION

In contrast to the prior art, the present invention provides a patch or access module with an improved switch-contact means. This means includes means for switching or electrically disconnecting the normally connected computer and modem leads and means for making electrical contact between the desired leads in the patch module and the patch plug in a way which significantly reduces the wear normally occuring during such electrical connection.

More specifically, the switch and contact mechanism of the present invention includes a switch and contact element having a first or contact portion for electrical engagement with a first contact point on the printed circuit board, a second or switch portion normally electrically engaged with a second contact point on the printed circuit board and a third or contact portion spaced from the printed circuit board and adapted for electrical connection with a corresponding contact element in the patch plug. The mechanism is constructed such that the third portion is adapted for limited movement either toward or away from the printed circuit board upon insertion or withdrawal of the patch plug. Such movement of the contact portion causes corresponding movement of the second or switch portion out of electrical engagement with the second contact point on the printed circuit board. This particular construction results in reduced wear which is normally present when electrical contact is made between contacts on the patch plug and contact pads or portions directly connected with the surface of the printed circuit board.

In the preferred embodiment of the present invention, the switch and contact mechanism includes an elongated spring member having a circuit board contact portion in electrical contact with one of the computer or modem leads, a switch portion normally engaged with a contact pad on the printed circuit board and a contact portion spaced from the printed circuit board and adapted for engagement with a corresponding contact portion on the patch plug. The spring member is stressed to insure normal electrical engagement between the circuit board contact and switch portions with their corresponding contacts on the printed circuit board. As the patch plug is inserted, the patch plug contact portion is moved outwardly with respect to the printed circuit board by its corresponding contact portion of the patch plug, thus causing disengagement between the switch portion and its corresponding contact on the printed circuit board.

Accordingly, a primary objective of the present invention is to provide a patch module having an improved switch and contact mechanism.

Another object of the present invention is to provide an improved switch and contact mechanism for a patch module in which the wear normally present in such devices is substantially reduced or eliminated.

A further object of the present invention is to provide an improved switch and contact mechanism for a patch module having a contact portion spaced from and adapted for limited movement relative to the printed circuit board upon insertion of the patch plug.

Another object of the present invention is to provide a switch and contact mechanism for a patch module in which the switch portion is electrically disconnected from its corresponding contact on the printed circuit board as a result of the above-described movement of the contact portion.

These and other objects of the present invention will become apparent with reference to the drawings, the description of the preferred embodiment and the appended claims.

DESCRIPTION OF THE PREFERRED EMBODIMENT

Figure 1:
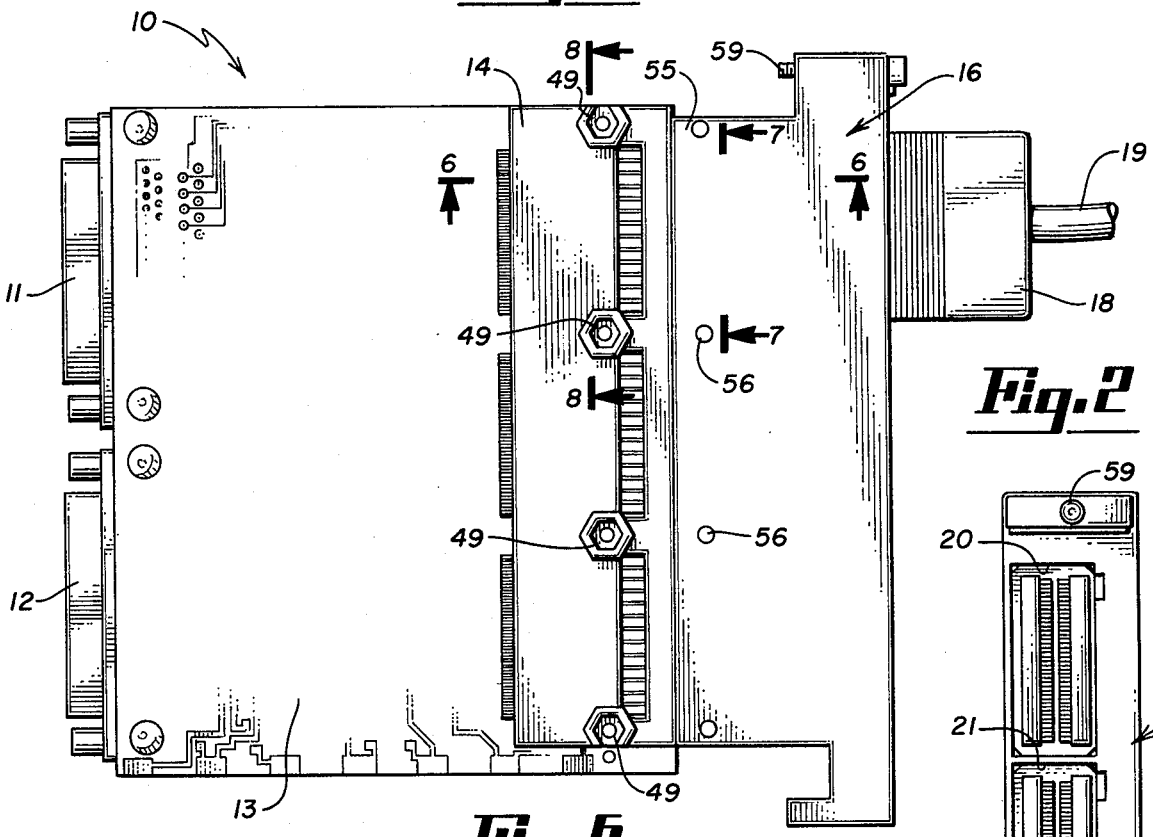
FIG. 1 is an elevational side view of a patch or access module with a patch plug inserted into the access opening accociated with the computer.
Figure 2:
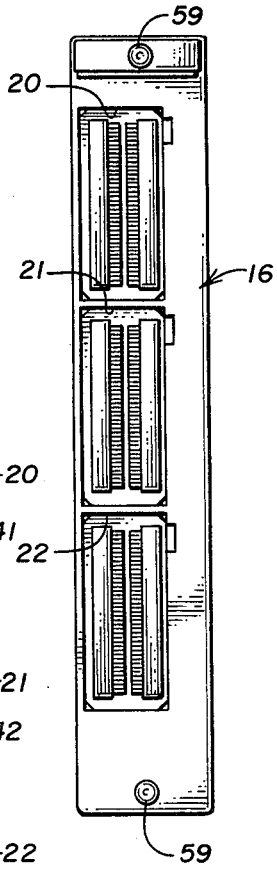
FIG. 2 is an elevational end view of the patch or access module shown in FIG. 1 with the patch plug removed.
Figure 3:
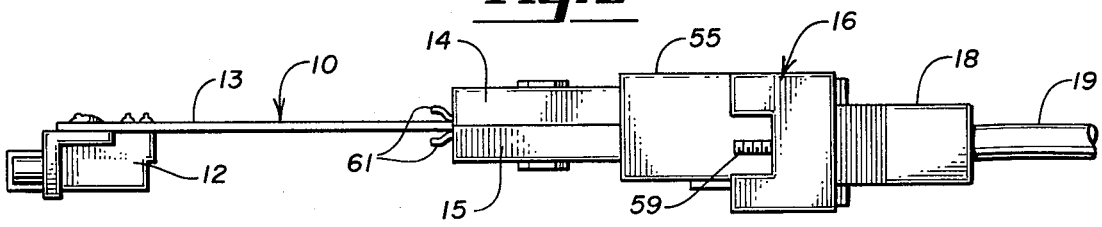
FIG. 3 is an elevational top view of the patch or access module shown in FIG. 1 with a patch plug inserted therein.

The patch or access module within which the switch-contact mechanism of the present invention is embodied is illustrated generally in FIGS. 1, 2 and 3 by the reference numeral 10. As shown in FIGS. 1 and 3, the patch module 10 includes a printed circuit board 13, a pair of rear connectors 11 and 12, a pair of side retainers or housing sections 14 and 15 disposed on opposite sides of the printed circuit board 13 and a forward end section 16 encircling a portion of the housing members 14 and 15. The end section 16 includes a portion disposed forwardly of the printed circuit board 13. The end view of the patch module 10 illustrated in FIG. 2 shows the forward end section 16 as including three access openings 20, 21 and 22 associated with leads for computer, modem and monitor function, respectively. The access openings are adapted for insertion of a patch plug 18 (FIGS. 1 and 3).

Figure 5:
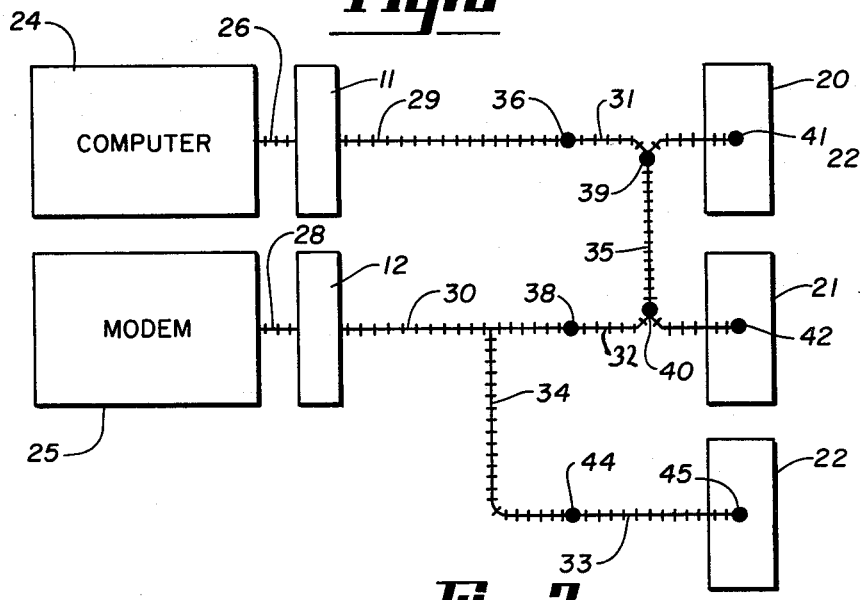
FIG. 5 is a schematic circuit diagram of the patch module of the present invention.

In the preferred embodiment as illustrated in the schematic illustration of FIG. 5, a piece of local equipment 24 which in some cases may be a computer is connected over a multi-wire line 26 to the connector 11 at the rear of the patch module. The multi-wire line 26 may consist of any number of individual wires, but generally consists of at least twenty-four or more wires or leads. Similarly, in the preferred embodiment, a modem 25 is connected by a multi-wire line 28, to the connector 12. As with the line 26, the line 28 may consist of any number of wires or leads, but usually consists of at least twenty-four or more. The modem 25 is normally connected to a common carrier or other communications line by which information or signals can be transmitted to and from the modem 25.

Within the patch module, the leads from the connector 11 are conncted via the multi-wire line 29 and the multi-connector element 31 to the multiple contact points 39. Similarly, the leads from the connector 12 are connected via the multi-wire line 30 and the multi-connector element 32 to the multiple contact points 40. The contact points 39 and 40 are electrically connected by the multi-wire line 35. Each of the multi-wire lines 29, 30 and 35 represent a plurality of printed leads on the printed circuit board 13 (FIG. 4) while each of the multi-connector elements 31 and 32 represent a switch-contact element of the type illustrated in FIGS. 11 and 12 and which will be described in greater detail below. When the multi-connector elements 31, 32 are in their normal position as illustrated schematically in FIG. 5, the multi-wire line 29 is electrically connected with the multi-wire line 30, thus electrically connecting the computer 24 with the modem 25. As will be discussed in more detail below, when a patch plug 18 (FIG. 1) is inserted into either the computer access opening 20 or the modem access opening 21 (FIG. 2), electrical engagment is made between the patch plug contacts and the respective contacts 41 and 42 at the ends of the switch-contact elements 31 and 32. This in turn causes the elements 31 or 32 to be disengaged from their respective contact points 39 or 40, thus providing access to either the computer 24 or the modem 25 by the patch plug 18.

In the patch module of the preferred embodiment, a multi-wire line 34 is also electrically connected between the multi-wire line 30 and the contact point 44. The contact point 44 is in turn connected with the multi-connector element 33 to provide monitor access at the opening 22 (FIG. 2).

Figure 4:
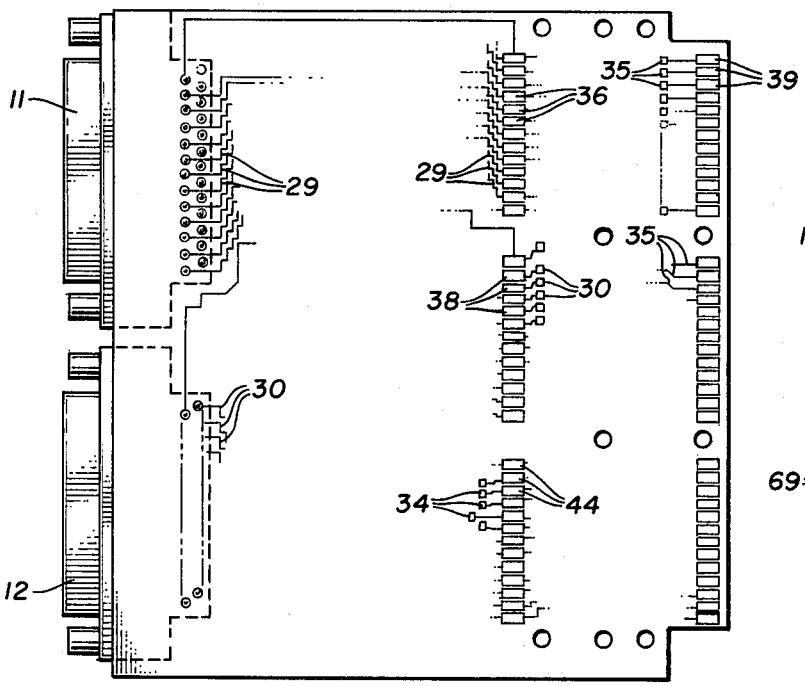
FIG. 4 is an elevational side view of the printed circuit board of the patch module of the present invention.

An elevational view of one side of the printed circuit board 13 is illustrated in FIG. 4. As shown, each of the wires or leads 29 from the connector 11 is electrically connected with a first equipment contact pad or portion 36 on the surface of the printed circuit board 13. A second equipment contact pad or portion 39 corresponding to each of the pads 36 is disposed on the surface of the printed circuit board 13 in a position spaced forward from the first set of contact pads 36. Similarly, each of the wires or leads 30 from the connector 12 is electrically connected with a first modem contact pad or portion 38 on the surface of the printed circuit board 13. A second modem contact pad or portion 40 corresponding to each of the pads 38 is disposed on the surface of the printed circuit board 13 in a position spaced forward from the first set of pads 38. The second set of contact pads 39 is electrically connected with the second set of modem contact pads 40 by a plurality of wires or leads 35.

A plurality of monitor contact pads or portions 44 are disposed on the surface of the printed circuit board 13 and are electrically connected with the leads 30 via the leads 34. With this construction, the data transmission circuit between the computer and modem connectors 11 and 12 can be monitored without interruption of the circuit. It should be noted that in the preferred embodiment, each of the contact pads 36, 38, 39, 40 and 44 comprises a gold plate contact pad secured to the surface of the printed circuit board 13. The opposite side of the printed circuit board 13 (not shown) includes a similar construction of multiple wire leads and contact pads.

Figure 9:
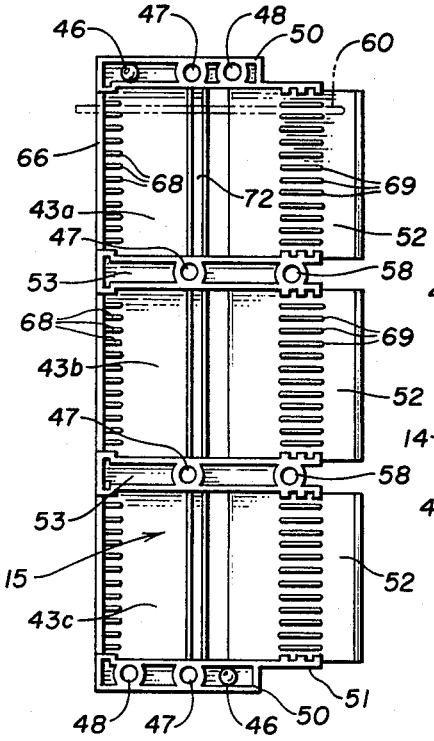
FIG. 9 is an elevational view of the inside portion of one of the side housing members showing the switch-contact elements in phantom.
Figure 10:
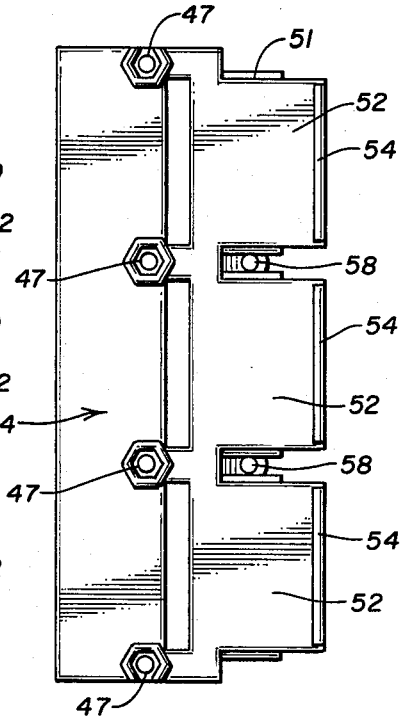
FIG. 10 is an elevational view of the opposite side of the side housing member shown in FIG. 9.

As illustrated best in FIGS. 1 and 3 and FIGS. 9 and 10, the housing members 14 and 15 are adapted for positioning on opposite sides of the printed circuit board 13. Each of the housings 14 and 15 includes a pair of edge portions 50, 50 and a pair of intermediate portions 53, 53 having a surface adapted for face-to-face engagement with one side of the printed circuit board 13. The edge portions 50, 50 each include an alignment post 46 extending outwardly therefrom to properly position the housing members 14 and 15 with respect to the printed circuit board 13. Each of the alignment posts 46 extends through a corresponding opening in the printed circuit board and into a corresponding recess portion 48 in the other housing member. The members 14 and 15 are retained together by a plurality of threaded members 49 (FIG. 1) extending through the holes 47 (FIGS. 9 and 10).

Each of the housing members 14 and 15 also includes a reduced neck portion 51 around which a rearward portion 55 of the end section 16 is disposed and three latching end sections 52 disposed forwardly of the neck portion 51. The latching end sections 52 correspond to three bays or sections **43*a*, 43*b* and 43*c* of the housing members 14 and 15 which are defined by the edge and intermediate portions 50, 50, 53 and 53. As shown in FIG. 10, each of the forward latching ends 52 includes an integral latching rib 54 for engagement with a portion of the plug member 18 (FIG. 1**) when inserted.

Figure 7:
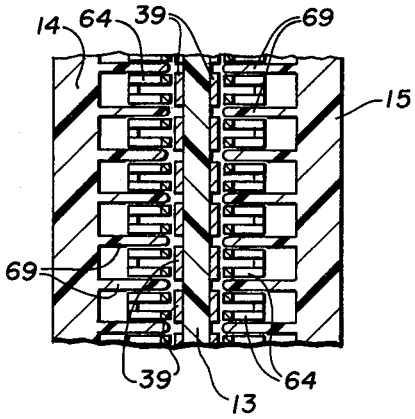
FIG. 7 is a view, partially in section, as viewed along the section line 7—7 of FIG. 1.

A plurality of forwardly positioned ribs 69 are disposed in each of the bays **43*a*, 43*b* and 43*c* for retaining a plurality of switch-contact elements 60 in alignment with the various contact pads on the surface of the printed circuit board 13. As shown in FIG. 7, the ribs 69 also electrically insulate adjacent members 60 from each other. Each bay 43*a*, 43*b* and 43*c* also includes a rearward edge 66 and a plurality of tabs or ribs 68. As illustrated best in FIG. 6, the rearward edge 66 limits longitudinal movement of the member 60 with respect to the housings 14 and 15. The ribs 68, similar to the ribs 69, function to properly align the elements 60 with respect to corresponding contact pads on the printed circuit board and to electrically insulate adjacent switch-contact members 60** from one another.

With reference to FIGS. 1, 2 and 3, the forward end section 16 is of unitary construction having a rearward portion 55 encircling the neck portion 51 of the members 14 and 15. The forward end of the section 16 includes three access openings 20, 21 and 22 to provide electrical access to the leads associated with the computer, modem and monitor function, respectively. The rearward portion 55 of the end section 16 slides over and encircles the neck section 51 of the members 14 and 15 and is secured thereto by a pair of screws 56 (FIG. 1) extending through the holes 58 (FIGS. 9 and 10) in the housing elements 14 and 15. The front face of the end section 16 includes a pair of screws 59 for retaining the entire assembly 10 within an appropriate chassis or frame.

Figure 11:
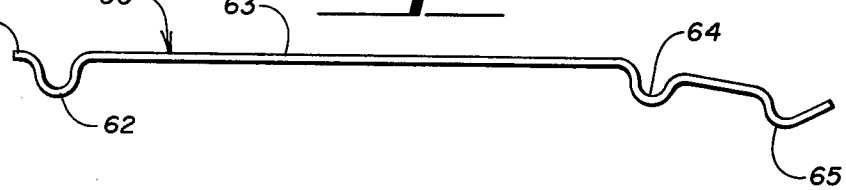
FIG. 11 is an elevational side view of one of the switch-contact elements of the present invention.
Figure 12:
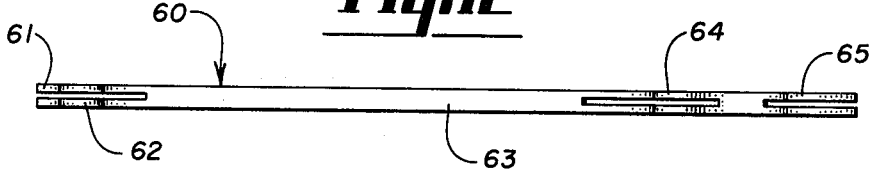
FIG. 12 is an elevational top view of one of the switch-contact elements of the present invention.

A plurality of switch-contact elements 60 of the type illustrated in FIGS. 11 and 12 are disposed within the side housing members 14 and 15 for cooperation with the corresponding contact pads 36, 38, 39, 40 and 44 (FIGS. 4 and 5) on the printed circuit board. Each of the switch-contact elements 60 of the present invention is an elongated spring element and includes a rearward end section 61, a first or contact portion 62 adapted for electrical engagement with a first contact pad on the printed circuit board, an elongated intermediate section 63, a second or switch portion 64 adapted for selective electrical engagement with a second contact pad on the printed circuit board and a third or contact portion 65 adapted for electrical engagement with a contact element on the patch plug 18 (FIGS. 1 and 3) when the plug is inserted into the patch module 10. Each of the first, second and third portions, 62, 64 and 65 respectively, includes a curved or humped portion and is electrically connected with the others. As shown in FIG. 12, the portions of the switch-contact member 60 in the area of the portions 61, 62, 64 and 65 are bifurcated. The purpose of this bifurcation is to provide independent movement of the bifurcated portions at the points of contact. This assures electrical contact at such points even if one of the bifurcated portions is prevented from doing so because of contamination or a dislodged particle at the point of contact.

The particular relationship between the elements 60, the printed circuit board 13 and the side housing members 14 and 15 is best seen by reference to FIGS. 6, 7, 8 and 9. With specific reference to FIG. 6 it can be seen that the first or contact portion 62 of each of the elements 60 in section **43*a* (FIG. 9) is in electrical engagement with a corresponding contact pad 36 disposed on the surface of the printed circuit board 13. The element 60 is retained in this position by the edge 66 which is disposed within the humped portion 62 and the ribs 68 and 69. A means for biasing the element 60 toward the circuit board 13 in the form of a cylindrical spring stress pin 72 is positioned between a pair of supporting edges 70 and 71. This pin 72 causes stress in the elongated intermediate portion 63 of the member 60 which forces it in a direction toward the printed circuit board 13 to insure good electrical engagement between the portions 62 and 64 and their associated contact pads 36 and 39. As illustrated in FIG. 9, a stress pin 72 is provided in each of the bays 43***a*, 43*b* and 43*c* and is disposed at right angles with respect to the switch-contact elements 60.

Figure 6:
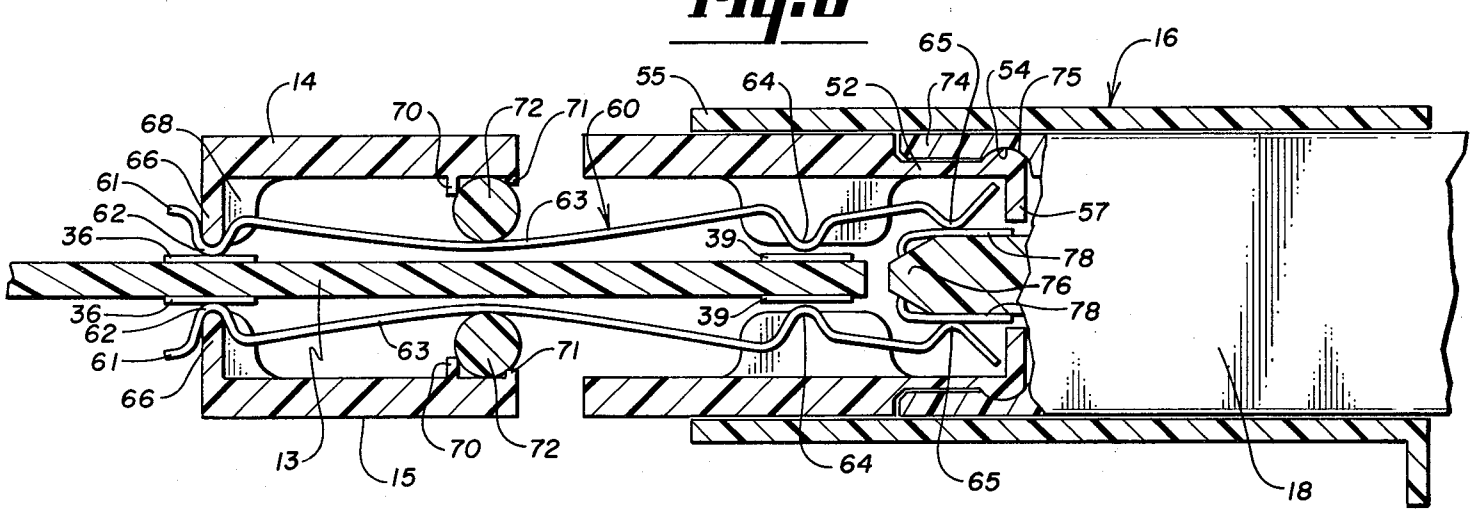
FIG. 6 is a view, partially in section, as viewed along the section line 6—6 of FIG. 1.
Figure 6A:
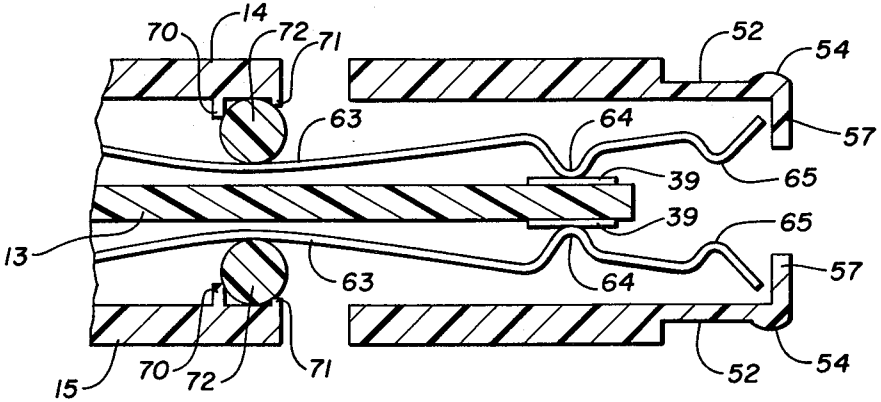
FIG. 6*a* is a view similar to FIG. 6 with the patch plug removed.

The second or switch portion 64 of the element 60 is adapted for selective electrical engagement with the contact pad 39 disposed on the surface of the printed circuit board 13. The third or contact portion 65 of the element 60 is adapted for electrical engagement with a corresponding contact element 78 associated with the patch plug 18. As shown in FIGS. 6 and 11, the third portion 65 includes a humped or curved portion disposed toward the printed circuit board 13 to insure good electrical engagement with the contact element 78. The relationship between the switch-contact element 60 and the patch plug 18 is such that when the patch plug 18 is properly inserted within the patch module 10, electrical engagement is made between the third or contact portion 65 and the contact element 78. This insertion of the patch plug 18 also results in movement of the portion 65 away from the printed circuit board 13, thus also resulting in movement of the second or switch portion 64 out of electrical engagement with the contact pad 39.

The forward ends of each of the side housing members 14 and 15 include a forwardly extending portion 52, a rib section 54 extending at generally right angles with respect to the elements 60 and an inwardly extending end portion 57. The patch plug 18 includes a peripheral portion 74 encircling the set of contact elements 78. A recessed section 75 is formed within the portion 74 for engagement with the rib 54 upon insertion of the patch plug 18 into the patch module 10.

Figure 13:
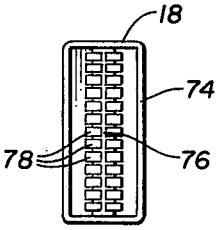
FIG. 13 is an elevational end view of the patch plug adapted for use with the patch module of the present invention.

As shown in FIG. 6 and also in FIG. 13, the patch plug 18 includes a plurality of contact elements 78 adapted for electrical engagement with corresponding switch-contact elements 60 in the patch module. Each of these contact elements 78 is electrically insulated from one another by an insulated portion 76.

Figure 14:
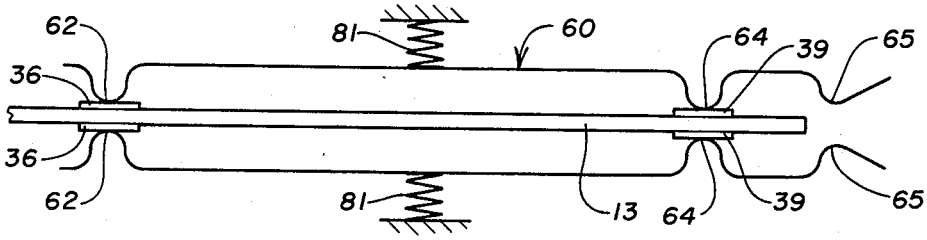
FIG. 14 is a schematic view of an alternate embodiment of a switch-contact mechanism of the present invention.

It should be noted that in the preferred embodiment, each of the switch-contact elements 60 is constructed of a spring metal so that the stress caused by the stress pins 72 causes the contact and switch portions 62 and 64 to engage the corresponding contact pads associated with the printed circuit board 13. It is contemplated, however, that alternate embodiments could be constructed from relatively stiff or rigid material and still obtain the benefits of the present invention. For example, as illustrated by the schematic of FIG. 14, if the switch-contact element 60 were relatively rigid, the stress force could be provided by a spring element 81 biasing the switch-contact element toward the printed circuit board 13. In such embodiment, insertion of the patch plug 18 would cause the third or contact portion 65 of the element 60 to be moved away from the printed circuit board 13 against the force of the spring element 81, thus electrically disconnecting the portion 64 from the contact pads 39. An important feature of the above structure which continues to exist, however, is the electrical contact between the portion 65 of the switch-contact element 60 and the contact element 78 of the plug 18.

Figure 15:
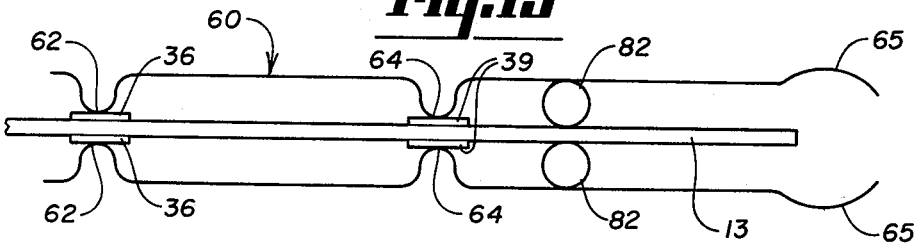
FIG. 15 is a schematic view of a further alternate embodiment of a switch-contact mechanism of the present invention.

It is also contemplated that a further embodiment could be constructed as illustrated in FIG. 15 in which the electrical engagement between the contact element in the patch plug 18 could be made with the outer surface of the third portion 65, thus causing movement of the third portion 65 toward the printed circuit board 13 upon insertion of the patch plug 18. If a fulcrum or other pivot point 82 is provided between the contact portion 65 and the switch portion 64, downward movement of the contact portion 65 as a result of insertion of the plug 18 will result in upward movement of the switch portion 64 and thus electrical disconnection between such portion and the contact pad 39. In both of the above possible alternate designs, electrical contact is made between the contact element 78 in the patch plug 18 and a portion of the switch-contact element 60 rather than between the contact element 78 in the patch plug 18 and a contact pad on the printed circuit board as in the prior art.

Figure 8:
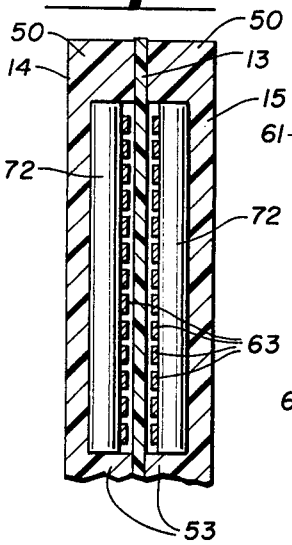
FIG. 8 is a view, partially in section, as viewed along the section line 8—8 of FIG. 1.

It should be noted that although only one of the switch-contact elements 60 has been described in detail, the patch module 10 includes a plurality of such elements in each of the bays or sections 43*a*, 43*b* and 43*c* (FIG. 9). Further, a set of the elements 60 and related structure is disposed on both sides of the printed circuit board 13 as illustrated in FIGS. 6, 7 and 8. Also, although the term patch module has been used to describe the present invention, its function is not limited to patching one set of leads to those of another. The patch module of the present invention is intended to include structures providing either patching or monitoring functions in addition to patching.

FIG. 15 is a schematic view of a further alternate embodiment of a switch-contact mechanism of the present invention.

Having described the preferred embodiment of the present invention in detail, the operation can be understood as follows. During normal operation of the patch module 10, the leads 29 (FIGS. 4 and 5) are electrically connected with the modem leads 30 via appropriate contact elements on the printed circuit board 13 and as a result of the various switch-contact elements 60 within the module. However, if it is desired to electrically connect the computer leads 29, for example, with the modem leads of a second patch module, the patch plug 18 on one end of the patch cord 19 (FIGS. 1 and 3) is inserted into the computer access opening 20 (FIG. 2) and the patch plug at the other end of the patch cord is inserted into the modem opening 21 in the patch module containing the desired modem leads. As described above, when the plug 18 is inserted, electrical engagement is made between the contact elements 78 in the plug 18 and the contact portions 65 of elements 60. This engagement causes the portions 65 to be moved outwardly away from the circuit board 13, thus also resulting in electrical disengagement between the second or switch portion 64 of the switch-contact elements 60 and the contact pads 39. This results in electrical disconnection between the leads 29 and 30 of the same patch module.

Although the description of the preferred embodiment has been quite specific it is contemplated that various modifications could be made to the present invention without deviating from the spirit of the present invention. Some of these alternate embodiments have been suggested in the above description and drawings. Accordingly it is intended that the scope of the present invention be dictated by the appended claims rather than by the description of the preferred embodiment.

I claim:

1. A patch module usable with an insertable patch plug having at least one electrical contact element, said patch module comprising:

a circuit board;

a first electrical circuit electrically connected with a first point on said circuit board;

a second electrical circuit electrically connected with a second point on said circuit board, said first and second points being electrically insulated from each other; and switch-contact means for selectively making electrical connection between said first point and said second point and for making electrical connection between said first point and the electrical contact element of said patch plug upon insertion of said patch plug into said patch module, said switch-contact means having a first portion electrically engaged with said first point, a second portion adapted for selective electrical engagment with said second point and a third portion adapted for limited movement relative to said circuit board for electrical engagement with the electrical contact element of said patch plug as a result of insertion of said patch plug into said patch module, said first, second and third portions of said switch-contact means being electrically connected with each other.

2. The patch module of claim 1 wherein said circuit board includes a surface and said first and second points are disposed on said circuit board surface.

3. The patch module of claim 2 wherein said third portion is spaced from said circuit board and is adapted for movement away from said circuit board as a result of insertion of said patch plug into said patch module.

4. The patch module of claim 3 wherein said switch-contact means comprises an elongated spring element having said first portion disposed at one end, said third portion disposed at the other end and said second portion disposed between said first and third portions.

5. The patch module of claim 4 including bias means for biasing said first and second portions into electrical engagement with said first and second points.

6. The patch module of claim 5 including a housing connected with said circuit board for retaining and aligning said switch-contact means, said housing having an inner surface spaced from said circuit board surface.

7. The patch module of claim 6 wherein said bias means includes an elongated spacing member disposed between said housing inner surface and a point on said switch-contact means between said first and second portions and at generally right angles to said switch-contact means.

8. The patch module of claim 4 wherein each of said first, second and third portions includes a humped portion disposed toward said circuit board.

9. The patch module of claim 8 wherein said switch contact means is bifurcated at each of said first, second and third portions.

10. The patch module of claim 2 including a housing connected with said circuit board for retaining and aligning said switch-contact means, said housing having an inner surface spaced from said circuit board surface.

11. The patch module of claim 10 wherein said housing includes a plurality of ribs for aligning said switch-contact means.

12. The patch module of claim 11 wherein said first portion includes a humped portion disposed toward said circuit board and said housing includes an edge disposed within said humped portion for limiting the movement of said switch-contact means within a longitudinal direction.

13. The patch module of claim 12 wherein said housing includes an end portion having a latching rib for latching engagement with said patch plug.

14. The patch module of claim 1 wherein said second portion is electrically disconnected from said second point as the result of said limited movement of said third portion.

15. The patch module of claim 1 wherein said first and second points include contact pads on said circuit board.

16. A patch and access assembly comprising a patch module and patch plug having at least an electrical contact element and being insertable into said patch module, said patch module comprising;

a circuit board;

a first electrical circuit electrically connected with a first point on said circuit board;

a second electrical circuit electrically connected with a second point on said circuit board, said first and second points being electrically insulated from each other;

switch-contact means for selectively making electrical connection between said first point and said second point and for making electrical connection between said first point and the electrical contact element of said patch plug upon insertion of said patch plug into said patch module, and switch-contact means having a first portion electrically engaged with said first point, a second portion adapted for selective electrical engagment with said second point and a third portion adapted for limited movement relative to said circuit board for electrical engagement with the electrical contact element of said patch plug as a result of insertion of said patch plug into said patch module, said first, second and third portions of said switch-contact means being electrically connected with each other; and said patch plug including an insulated center portion having an outer surface and said at least one electrical contact element being disposed on the outer surface of said center portion.

* * * * *